US006213161B1

(12) United States Patent
Schaich

(10) Patent No.: US 6,213,161 B1
(45) Date of Patent: Apr. 10, 2001

(54) HOLDER APPARATUS FOR WEFT THREAD IN A SERIES SHED WEAVING MACHINE

(75) Inventor: Urs Schaich, Eschenbach (CH)

(73) Assignee: Sulzer Rüti AG, Rüti (CH)

( * ) Notice: Subject to any disclaimer, the term of this patent is extended or adjusted under 35 U.S.C. 154(b) by 0 days.

(21) Appl. No.: 09/454,534

(22) Filed: Dec. 6, 1999

(30) Foreign Application Priority Data

Dec. 24, 1998 (EP) ..... 98811264

(51) Int. Cl.[7] ..... D03D 41/00
(52) U.S. Cl. ..... 139/28; 139/194
(58) Field of Search ..... 139/194, 28

(56) References Cited

U.S. PATENT DOCUMENTS 3,792,723 2/1974 Titov .
4,088,159 5/1978 Komarov .
4,587,996 * 5/1986 Steiner ..... 139/194

FOREIGN PATENT DOCUMENTS 2312709 9/1973 (DE) .
0 148 292 A1 7/1985 (EP) .
0 582 763 A1 2/1994 (EP) .
WO 96/38613 12/1996 (WO) .

* cited by examiner

*Primary Examiner*—Andy Falik
(74) *Attorney, Agent, or Firm*—Townsend and Townsend and Crew LLP

(57) ABSTRACT

An arrangement for the holding of a weft thread for a series shed weaving machine has a holder apparatus (11) for the weft thread (4). Two forwarding elements (12, 13) are arranged at both sides of the holder apparatus and are movable relative to the holder apparatus in order to introduce the weft thread. The weft thread (4) extends transversely to the holder apparatus and transversely to the holder apparatus and transversely to the direction of movement of the forwarding elements, into the holder apparatus and furthermore, an apparatus (14) in order to catch and to tension the weft thread. The holder apparatus comprises a thread clamp (15) with a stationary clamping part (17) and a movable clamping part (18) which is under spring action and which forms a clamping gap (27). The weft thread is held in a stretch state by the forwarding elements (12, 13) and the apparatus (14) and is displaceable transversely through the clamping gap. The required clamping force can be set in an advantageous manner through the thread clamp.

9 Claims, 3 Drawing Sheets

11
15
16
18
21
22
23
24
25
26
26
27
6
13
17

28

HOLDER APPARATUS FOR WEFT THREAD IN A SERIES SHED WEAVING MACHINE

BACKGROUND OF THE INVENTION

The invention relates to an arrangement for the holding of a weft thread for a series shed weaving machine and to a series shed weaving machine with an arrangement of this kind.

An arrangement of this kind is known from WO 96/38613. This arrangement contains two holder elements which are arranged stationarily and overlap at least sectionwise, at least two ring-shaped forwarding elements which are arranged parallel to one another and at a spacing on both sides of the holder arrangement and which are movably arranged relative to the latter in order to push a weft thread which extends transversely to the direction of movement of the forwarding elements and transversely to the holder elements between the holder elements, and a stretching nozzle in order to tension the weft thread in the insertion direction.

The rigid association of the holder elements and the forwarding elements relative to one another, i.e. with respect to one another, proves to be disadvantageous because a holding force is present thereby which can not be changed for the use of different weft yarns without greater cost and complexity. In addition the setting is critical.

SUMMARY OF THE INVENTION

An arrangement for the holding of a weft thread for a series shed weaving machine has a holder apparatus (11) for the weft thread (4). Two forwarding elements (12, 13) are arranged at both sides of the holder apparatus and are movable relative to the holder apparatus in order to introduce the weft thread. The weft thread (4) extends transversely to the holder apparatus and transversely to the holder apparatus and transversely to the direction of movement of the forwarding elements, into the holder apparatus (11) and furthermore, an apparatus (14) in order to catch and to tension the weft thread. The holder apparatus comprises a thread clamp (15) with a stationary clamping part (17) and a movable clamping part (18) which is under spring action and which forms a clamping gap (27). The weft thread is held in a stretch state by the forwarding elements (12, 13) and the apparatus (14) and is displaceable transversely through the clamping gap. The required clamping force can be set in an advantageous manner through the thread clamp.

The object of the invention is to improve an arrangement for the holding of a weft thread and to simplify the setting of the clamp.

This object is satisfied in accordance with the invention by the characterising features of claim 1.

The advantage that can be achieved with the invention is to be seen in the simplified settability of the clamping force.

In the following the invention will be explained with reference to the drawings.

Shown are:

DESCRIPTION OF THE PREFERRED EMBODIMENT

Figure 1:
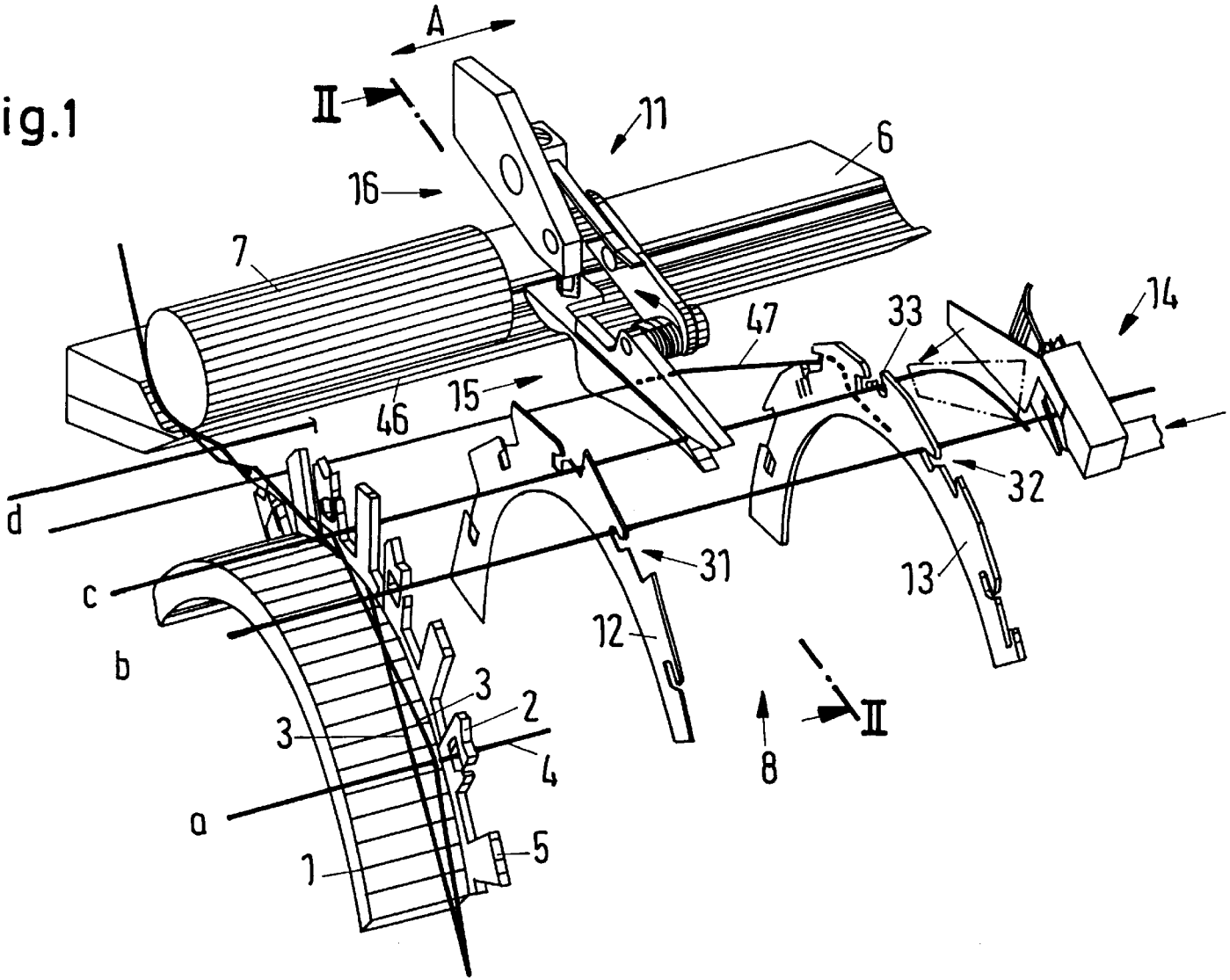
FIG. 1 is an embodiment of an arrangement in accordance with the invention in a spatial and pulled apart illustration.

FIG. 1 shows a weaving rotor 1 having shed forming elements 2 with means for forming the sheds from warp threads 3 and with an opening for shooting the weft threads 4 through and beat-up elements 5 in order to beat up the weft threads at the cloth edge, a cloth table 6 which cooperates with the beat-up elements, a temple 7 for the cloth and an embodiment of an arrangement 8 for the holding of weft threads 4 which is arranged outside the web width. The arrangement 8 comprises a holder apparatus 11 for the weft thread, two forwarding elements 12, 13 in order to introduce the weft thread into the holder apparatus and an apparatus 14 in order to tension the weft thread. The holder apparatus 11 contains a thread clamp 15 and a module 16. The thread clamp 15 contains a stationary clamping part 17 and a movable clamping part 18. The stationary clamping part 17 is supported on a cloth table 6 and is connected via a spring 19 to the module 16. The movable clamping part 18 is arranged at the module 16. The module 16 is displaceable in the direction of the double arrow A in order to set the position of the component with respect to the weaving rotor 1, stated more precisely, during a change of web width. With a reduction of the web width the cloth support need not be reduced in length.

The module 16 comprises a carrier 21, a lever 22 which is journalled at one end at the carrier 21 and which is provided with a pin 23 and with a setting member 24 for the movable clamping part 18 and which connects the movable clamping part 18 to the lever 22, a leaf spring 25 which is fastened at the one end at the carrier 21 and lies at the other end in contact on the pin 23 and a torsion spring 26 which surrounds a section of the setting member 24 and is secured at the one end at the lever 22 and at the other end at the movable clamping part 18.

Figure 2:
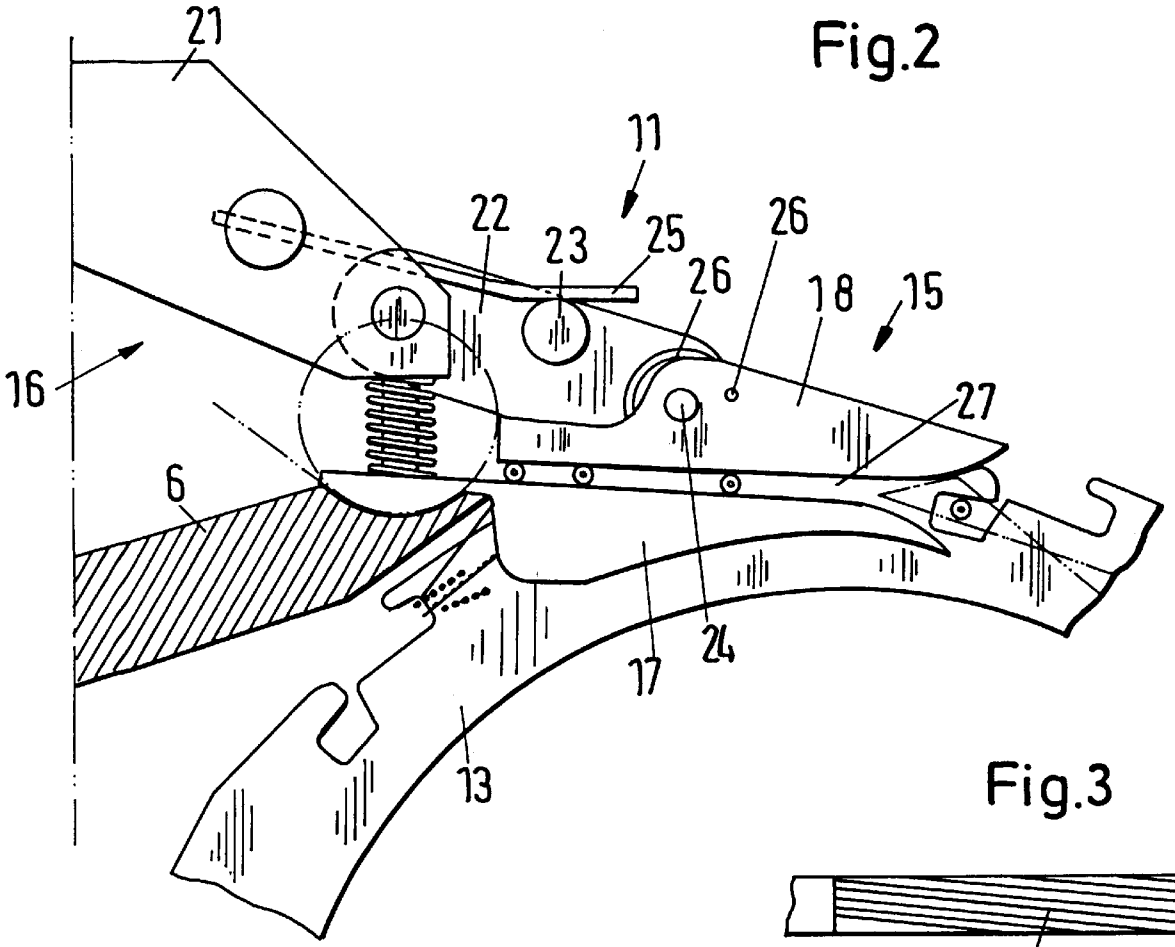
FIG. 2 is a section along the plane II—II in FIG. 1.

As FIG. 2 shows the stationary and the movable clamping parts 17, 18 form a clamping gap 27. As already mentioned, the torsion spring 26 is connected to a setting member 24 which is rotatably arranged in the lever 22. The spring force can be varied with this setting member 24 so that the clamping gap 27 converges more or less. In this way a situation is achieved in which, on the one hand, the clamping force has a lower strength at the entry side and the weft thread is more strongly clamped and as a result is held better with increasing penetration depth.

The forwarding elements 12, 13 are ring-shaped discs which can be connected to the weaving rotor 1 parallel to and at a spacing from one another in such a manner that the free end of the thread clamp 15 is arranged between the forwarding elements and indeed in the region of the edge part of the weaving rotor. In this edge part the forwarding elements 12 and 13 are in each case formed with cut-outs 31, 32 (FIG. 1), the number of which corresponds to the number of the weft insertion passages. The cut-out 32 differs from the cut-out 31 in that a hook-like section 33 is present. The latter serves for the pulling out of the weft thread out of the apparatus 14.

Figure 3:
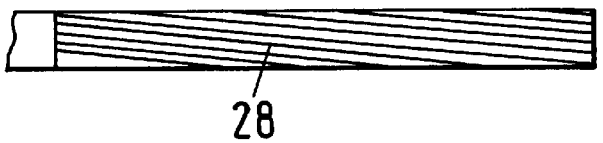
FIG. 3 is a view of the clamping surface.

As FIG. 3 shows, the clamping surfaces of the thread clamp are provided with grooves 28 which are arranged at an inclination with respect to the path of travel of the weft threads 4 such that weft threads which are introduced into the clamp receive an imparted stretching effect in the insertion direction.

Figure 4:
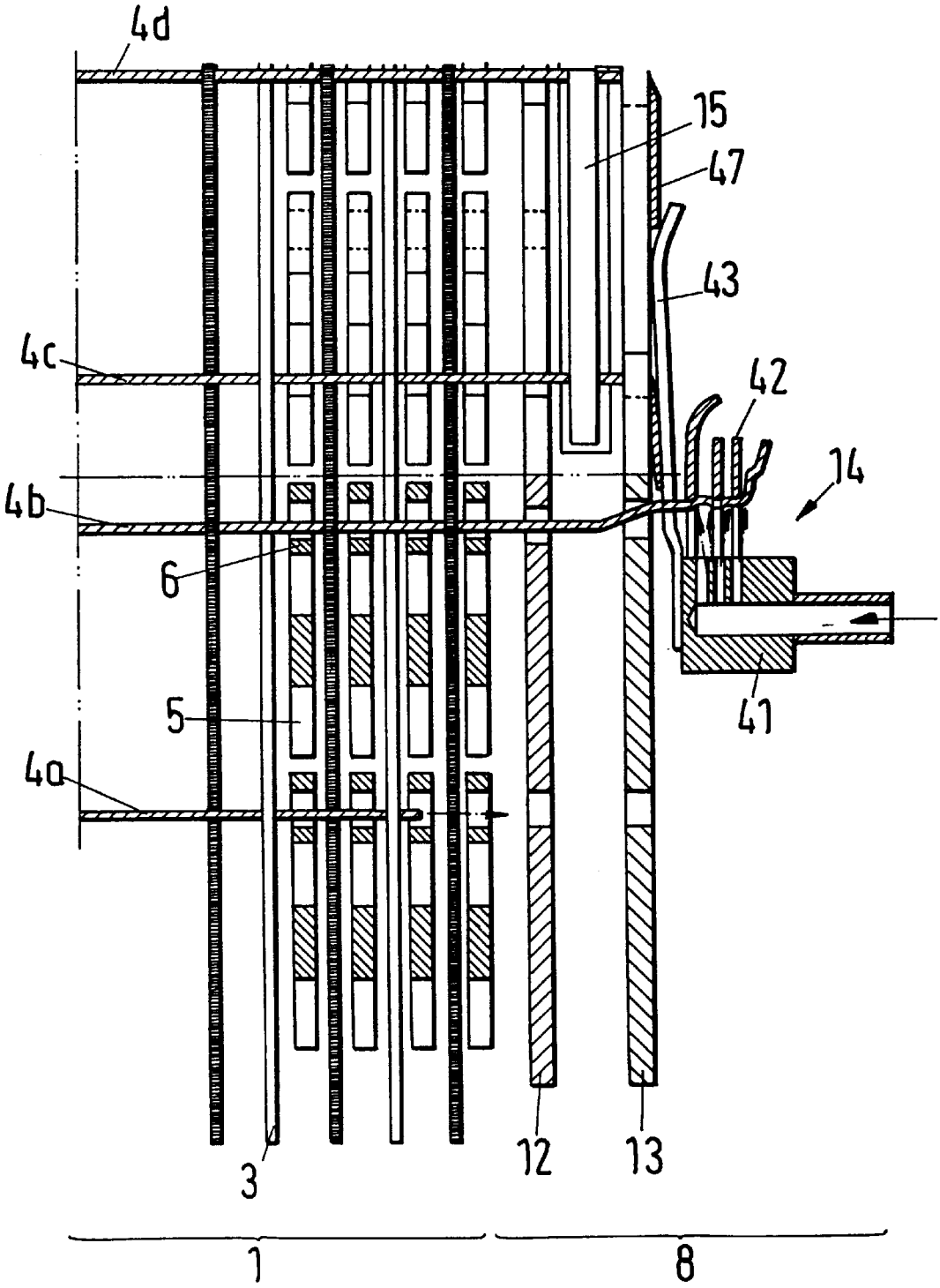
FIG. 4 is a plan view of a part of FIG. 1.

Reference is made to FIG. 4, which shows the association of the arrangement 8 with respect to the weaving rotor 1 and the association of the constituents of the arrangement with respect to one another. The apparatus 14 for the catching and tensioning of the weft thread 4 consists of a nozzle 41 with e.g. three outlets and three holder elements 42 and a lamella 43 which consists of a resilient material. The apparatus 14 is arranged in such a manner that the lamella 43 lies in contact under a bias force at the forwarding element 13.

In the following the function of the arrangement will be described with reference to FIGS. 1 and 4, with a weft thread being illustrated in different positions.

In the position a the weft thread 4 is subsequently forwarded through the cut-out 31, 32 of the forwarding elements 12, 13.

In the position b the weft thread has passed the forwarding elements and is held and tensioned by means of the apparatus 14.

In the position c the weft thread is introduced by means of the forwarding elements into the clamping gap of the thread clamp and the weft thread end is drawn out of the nozzle 41 and held between the forwarding element 13 and the lamella 43.

In the position d the weft thread, which is already clamped by the warp threads 3, is displaced to the cloth table 6. In this the weft thread is pushed through the clamping gap 27, with the weft thread being additionally tensioned by means of the inclined grooves in the clamping surfaces.

The arrangement comprises a holder apparatus 11 for the weft thread, two forwarding elements 12, 13 which are arranged at both sides of the holder apparatus and are movable relative to the holder apparatus in order to introduce the weft thread, which extends transversely to the holder apparatus and transversely to the direction of movement of the forwarding elements, into the holder apparatus 11 and furthermore comprise an apparatus 14 in order to catch and tension the weft thread. The holder apparatus comprises a thread clamp 15 with a stationary clamping part 17 and a movable clamping part 18 which is under spring action, which form a clamping gap 27, with the weft thread being held in a stretched position by means of the forwarding elements 12, 13 and the apparatus 14 and being displaceable transversely thereto through the clamping gap.

The required clamping force can be set in an advantageous manner through the thread clamp.

What is claimed is:

1. A holder apparatus for the holding of a weft thread for a series shed weaving machine comprising:

weft tensioning apparatus for receiving and tensioning weft thread;

a thread clamp having a stationary clamping part and a moveable clamping part;

a spring bias moving the stationary clamping part and the moveable clamping part toward one another to form a clamping gap; and, forwarding elements arranged on either side of the thread clamp and moveable relative to the thread clamp in order to remove weft thread from the weft tensioning apparatus and introduce the weft thread transversely to the thread clamp into the clamping gap.

2. A holder apparatus according to claim 1 and wherein the spring bias includes:

a first spring element to bias the moveable clamping part against the stationary clamping part; and, a second spring element to impart a torque to the moveable clamping part in order to provide a continuously increasing, elastic clamping force in the clamping gap.

3. A holder apparatus according to claim 1 and wherein the thread clamp includes:

grooves on the thread clamp arranged at an inclination to transverse introduction of the weft thread into the clamping gap.

4. A holder apparatus according to claim 1 and wherein the forwarding elements arranged on either side of the thread clamp includes:

a first forwarding element on one side of the clamping gap; and, a second forwarding element on the other side of the clamping gap.

5. A holder apparatus according to claim 1 and wherein the forwarding elements arranged on either side of the thread clamp are ring shaped discs.

6. A holder apparatus according to claim 1 and wherein the forwarding elements arranged on either side of the thread clamp are provided in the outer edge part of a weaving rotor with at least one cut-out for the reception of the weft thread.

7. A holder apparatus according to claim 1 and wherein one of the forwarding elements arranged on either side of the thread clamp includes a hook-like section.

8. A holder apparatus according to claim 1 and wherein the weft tensioning apparatus (14) includes a retainer element of a resilient material which contacts one of the forwarding elements.

9. A series shed weaving machine comprising in combination:

a weaving rotor;

shed forming elements on the weaving rotor for forming warp threads into sheds to define weft insertion passages;

a cloth table for receiving cloth woven from the warp and welt threads;

beat up elements for moving the welt threads into the warp threads at the cloth table;

welt tensioning apparatus for receiving and tensioning welt thread;

a thread clamp having a stationary clamping part and a moveable clamping part, the thread clamp supported from the cloth table and displaceable parallel to the weaving rotor;

a spring bias moving the stationary clamping part and the moveable clamping part (18) toward one another to form a clamping gap; and, forwarding elements arranged on either side of the thread clamp and moveable relative to the thread clamp in order to remove welt thread from the welt tensioning apparatus and introduce the welt thread transversely to the thread clamp into the clamping gap.

* * * * *